US006135079A

United States Patent [19]

Fuesser

[11] Patent Number: 6,135,079

[45] Date of Patent: Oct. 24, 2000

[54] AIR INTAKE SYSTEM FOR AN INTERNAL COMBUSTION ENGINE

[75] Inventor: Rolf Fuesser, Bad Herrenalb, Germany

[73] Assignee: Filterwerk Mann & Hummel GmbH, Ludwigsburg, Germany

[21] Appl. No.: 09/180,433

[22] PCT Filed: May 7, 1997

[86] PCT No.: PCT/EP97/02361

§ 371 Date: Mar. 2, 1999

§ 102(e) Date: Mar. 2, 1999

[87] PCT Pub. No.: WO97/42408

PCT Pub. Date: Nov. 13, 1997

[30] Foreign Application Priority Data

May 8, 1996 [DE] Germany ..... 196 18 432

[51] Int. Cl.[7] ..... F02M 35/10

[52] U.S. Cl. ..... 123/184.57; 123/184.53; 123/184.55

[58] Field of Search ..... 123/184.21, 184.53, 123/184.55, 184.56, 184.57; 181/229, 240, 204, 214

[56] References Cited

U.S. PATENT DOCUMENTS

| | | | |
|---|---|---|---|
| 4,539,947 | 9/1985 | Sawada et al. | 123/184.57 |
| 4,546,733 | 10/1985 | Fukami et al. | 123/184.57 |
| 5,002,021 | 3/1991 | Nakata et al. | 123/184.42 |
| 5,040,495 | 8/1991 | Harada et al. | 123/184.57 |
| 5,107,800 | 4/1992 | Araki et al. | 123/184.57 |
| 5,163,387 | 11/1992 | Lee | 123/184.38 |
| 5,377,629 | 1/1995 | Brackett et al. | 123/184.56 |
| 5,571,239 | 11/1996 | Kameda et al. | 123/184.53 |
| 5,571,242 | 11/1996 | Demorest | 123/184.21 |
| 5,572,966 | 11/1996 | Doddy et al. | 123/184.57 |
| 5,771,851 | 6/1998 | McLean | 123/184.57 |
| 5,783,780 | 7/1998 | Watanabe et al. | 181/229 |
| 5,806,480 | 9/1998 | Maeda et al. | 123/184.57 |
| 5,823,157 | 10/1998 | Muramatsu | 123/184.56 |
| 5,900,595 | 5/1999 | Akima et al. | 181/229 |
| 5,957,102 | 9/1999 | Schorn | 123/184.57 |

*Primary Examiner*—Tony M. Argenbright
*Assistant Examiner*—Hai Huynh
*Attorney, Agent, or Firm*—Evenson, McKeown, Edwards & Lenahan, P.L.L.C.

[57] ABSTRACT

An air intake system for an internal combustion engine in which the air, which is taken in, passes via an air filter (3) to the internal combustion engine through an intake passage within which a damping cavity volume (5) is provided which acts as a Helmholz resonator. The effective damping cavity volume (5) is sized such that a given noise frequency range can be attenuated, and in order to achieve optimum noise suppression, at least a partial flow of air passes through the damping cavity volume, and the size of the effective damping cavity volume (5) through which the air passes can be varied by reversible switches and/or valves.

3 Claims, 2 Drawing Sheets

AIR INTAKE SYSTEM FOR AN INTERNAL COMBUSTION ENGINE

The invention relates to an air intake system for an internal combustion engine

BACKGROUND OF THE INVENTION

In internal combustion engines for motor vehicles, in order to achieve optimum performance, air intake systems are preferred which do not have a fixed air intake volume but permit adaptation to different operating requirements of the engine. Also, noise suppression is important in this regard.

In EP 0 569 714 A1 an air intake system is disclosed which, for purposes of noise suppression, provides in the air intake system an additional cavity through which the air does not flow. Two selectively connectable resonance tubes (interference tubes) are present which at certain rotational speeds of the internal combustion engine perform a damping of the objectionable sound frequencies.

Furthermore, an air intake system for an internal combustion engine is disclosed in German Offenlegungsschrift 40 41 786 in which a controllable shut-off device is present in order to vary the aperture through which the aspirated air flows.

The shut-off means is situated in a transverse passage between two intake passages and is opened or closed by operational commands from an electronic control. The operational commands depend on the speed of rotation of the internal combustion engine and on the temperature of the outside air, which is determined by a temperature sensor.

A disadvantage in the state of the art is that a not inconsiderable part of the air intake and/or suppressor volume is shut off or is not active in the intake of air. Due to the scarcity of the space available in the engine compartment of modern motor vehicles, this is disadvantageous.

SUMMARY OF THE INVENTION

The invention is addressed to the problem of improving an air intake system for an internal combustion engine according to the preamble of the main claim such that optimum operational conditions, and especially noise suppression conditions, will prevail under all states of operation of the internal combustion engine and within the space available in the engine compartment.

The air intake system according to the invention solves the stated problem by the features set forth in the body of the principal claim.

The air intake system according to the invention is advantageous because the total volume of the air intake system is always active, but the noise-suppressing action can be varied such that the optimum noise suppression can be spread out over several rotational speed ranges with varying effect.

With a tubular switch according to claim 2, the air intake tube can be opened in the noise suppression cavity in a simple manner. By the diffusion of the noise in the cavity a Helmholtz resonator defined by the cavity size becomes active, which promotes the diffusion of a specific sound frequency range and suppresses a different range. By a parallel connection of a branching tube (interference tube) according to claim 2, certain sound frequencies can be selectively suppressed due to interferences depending on the length of the branching tube.

By the arrangement of a supplemental channel according to claim 3, the noise suppression cavity can be connected across a large area to the air filter cavity, so that through this direct coupling an addition is made to the noise-suppression cavity by the air filter cavity which also has a noise-suppressing action. The so-called Helmholtz resonance is determined by the total volume of these cavities and has a correspondingly low frequency, which leads to a suppression of noise in the lower rotational speed range of the internal combustion engine.

The embodiment according to claim 4 describes the flexibility with which the desired sizes and physical properties of the cavities can be manipulated. Due to its flexibility of adaptation, this switching method achieves good acoustical properties in the internal combustion engine and the vehicle. The necessary switching can be achieved in a simple manner using the other units of a motor vehicle in accordance with claim 5. Complex and expensive additional equipment outside of the air intake system is unnecessary according to the invention.

BRIEF DESCRIPTION OF THE DRAWINGS

An embodiment of the air intake system of the invention is explained below with reference to the drawing, wherein.

DETAILED DESCRIPTION OF A PREFERRED EMBODIMENT

Figure 1:
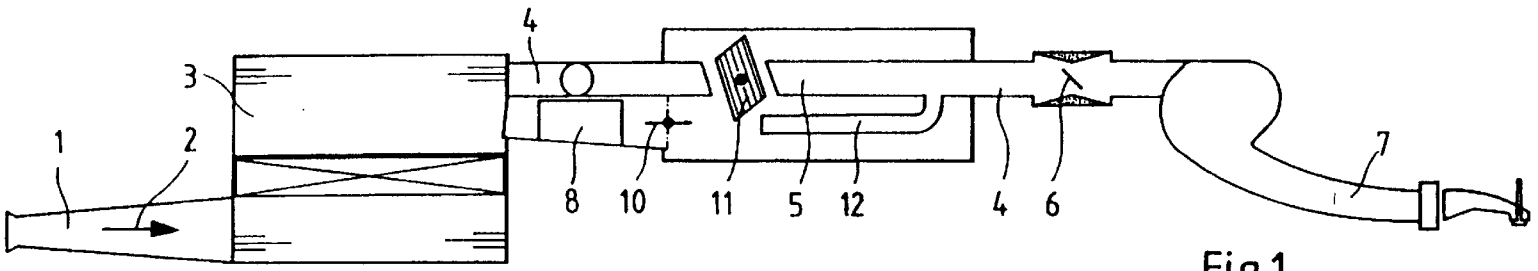
FIG. 1 is a schematic representation of an air intake system with a switchable noise-suppression cavity volume in a first switching position.

In FIG. 1 an air intake system 1 is shown for an internal combustion engine not shown, through which an air stream according to arrow 2 is drawn through an air filter 3. Behind the air filter 3, an air intake tube 4 leads through a noise damping cavity 5 to a throttle valve 6 and finally to the air induction tube 7 of the internal combustion engine. A supplemental channel 8 is arranged between the air filter 3 and the noise damping cavity 5.

In the interior of the noise suppression cavity 5 are a flap valve 10 for closing the supplemental channel 8, a tubular switch 11 for opening the air intake tube 4 to the interior of the noise damping cavity 5, and a branching tube 12 which extends from the air intake tube 4 through a given length parallel to the air intake tube 4, but in a direction opposite to that of the air stream 2, and is open at the end.

In illustration according to FIG. 1, the noise suppression cavity is connected over a large surface area with the air filter 3 since the valve 10 is open to the supplemental passage 8. The above-mentioned Helmholtz resonance is therefore determined by the sum of all opened cavities and accordingly is low in frequency. To clarify this situation refer to FIG. 4, in which the magnitude of the noise emission (db(A)) is shown in relation to the rotational speed (rpm) in all kinds of operation. A curve 21 as in FIG. 4 shows by way of example the comparatively great noise suppression in the lower rotational speed range.

Figure 2:
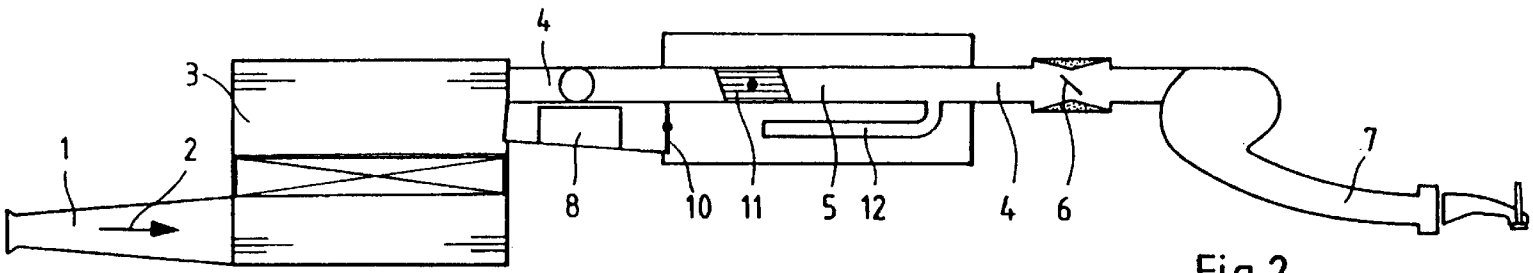
FIG. 2 is a schematic representation of an air intake system with a switchable noise-suppression cavity volume in a second switching position.

In FIG. 2 there is shown a switched position in which both the flap valve 10 to the supplemental passage and the tubular switch 11 are closed. Here the sound suppression cavity volume 5 is in shunt, since the branch tube 12 is the only element coupling the air intake tube 4 to the noise suppression cavity 5. Such shunted resonators are suitable for the selective suppression of particular noise components or sound frequencies by means of an appropriate length of the branching tube 12. Thus this switch position in FIG. 2 is suitable for use over the entire range of rotational speeds. In FIG. 4 is shown a curve 20 of the noise emission over the engine speed when the size of the branch tube 12 corresponds to a shunt resonance of 40 Hz, for the damping of very low sound frequencies.

Figure 3:
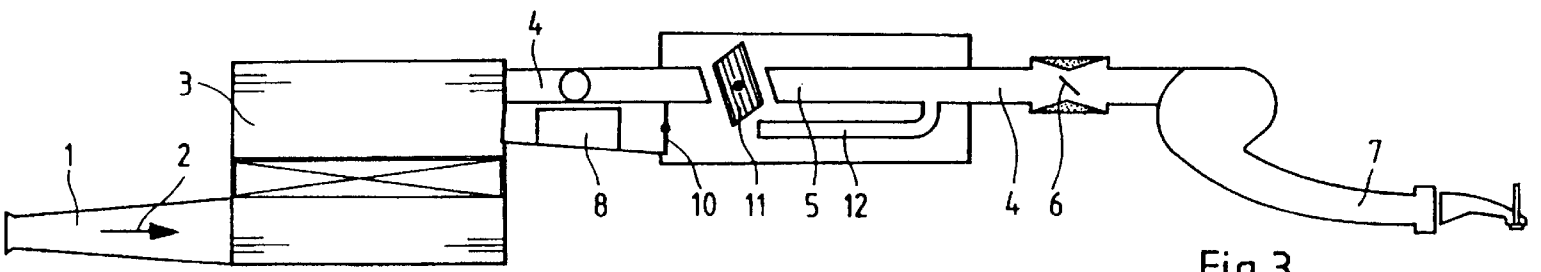
FIG. 3 is a schematic representation of an air intake system with a switchable noise-suppression cavity volume in a third switching position.

The illustration in FIG. 3 represents a switching position for a cavity of two chambers in which the noise-damping cavity 5 and the air filter cavity 3 are connected one after the other. By opening the tubular switch 11 and closing the supplemental passage 8, the two chambers are coupled to one another by a damper neck. In this case what is involved is a successive connection of two separate Helmholtz resonators that results in a suppression especially of the high sound frequencies. The course of the noise emission in this switching position is shown as curve 22 in FIG. 4.

Figure 4:
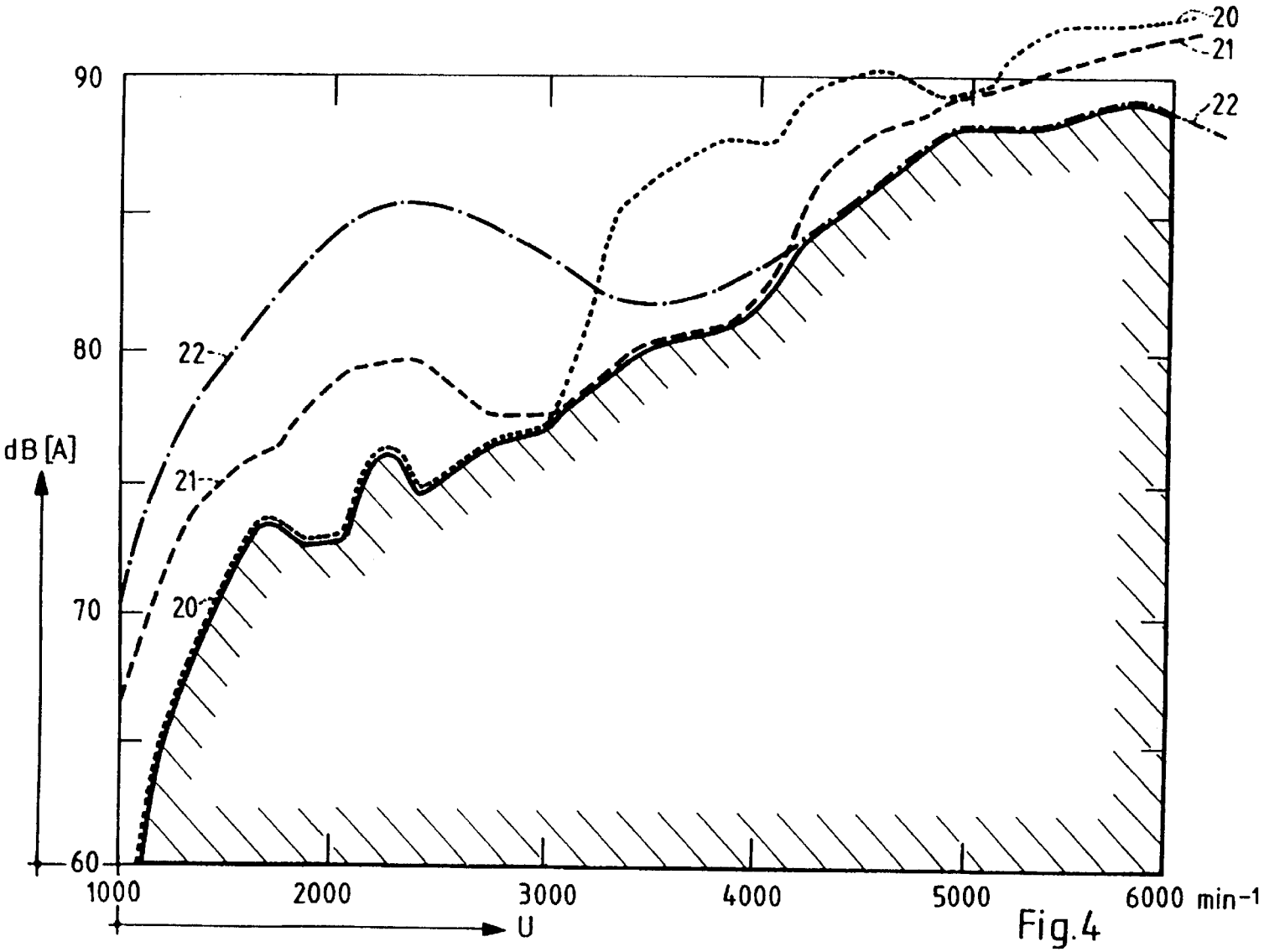
FIG. 4 depicts curves of the noise emission in the above switching positions depending on the speed of rotation of the internal combustion engine.

It can be seen in general from FIG. 4 that, if the three switched positions described are appropriately combined, an optimized noise emission can be achieved over all rotational speeds of the internal combustion engine. Thus, an appropriate, effective cavity volume can be achieved in a Helmholtz resonator for the adaptive reduction of noise in internal combustion engines.

What is claimed is:

1. An air intake system for an internal combustion engine, comprising an air filter, an air intake tube leading from said air filter to a throttle valve which in turn communicates with an intake manifold of the engine, and a noise damping chamber through which said air intake tube extends, said noise damping chamber having a volume sized to act as a Helmholtz resonator and attenuate undesired sound frequencies, wherein the air intake tube passes through the noise damping chamber and said noise damping chamber is in communication with said air intake tube such that the air drawn in through the air intake tube passes through at least part of the noise damping chamber volume, said system further comprising means for varying the volume of the sound damping chamber through which the air drawn in through the intake tube passes comprising an openable and reclosable tubular switch which communicates the air intake tube with the noise damping chamber, and an open branching tube of a given length arranged inside the damping chamber extending parallel to the intake tube in a direction opposite the flow of air through the damping chamber and communicating with the intake tube.

2. An air intake system according to claim 1, further comprising a closable supplemental air channel arranged between the air filter and the noise damping cavity.

3. An air intake system according to claim 2, wherein the effective size of the damping chamber is varied in dependence on the rotational speed of the internal combustion engine as follows:

a) for sound damping in a medium rotational speed range of the engine, the supplemental air channel and the tubular switch are opened;

b) for variable noise damping in the entire rotational speed range of the engine, the supplemental air channel and the tubular switch are closed, and noise damping characteristics of the system are determined by the length of the branching tube; and b) for variable sound damping in the entire rotational speed range, the supplemental air channel and the tubular switch are closed, and the desired damping characteristic is determinable by the length of the branching tube; and c) for sound damping in an upper rotational speed range of the engine, the supplemental air channel is closed, and the tubular switch is opened.

* * * * *